US005364421A

United States Patent [19]

Westby et al.

[11] Patent Number: 5,364,421

[45] Date of Patent: Nov. 15, 1994

[54] COAL BLENDS HAVING IMPROVED ASH VISCOSITY

[75] Inventors: Timothy S. Westby; Thomas G. McCord; Lynton W. R. Dicks, all of Houston, Tex.

[73] Assignee: Ziegler Coal Holding Company, Fairview Heights, Ill.

[21] Appl. No.: 738,406

[22] Filed: Jul. 31, 1991

[51] Int. Cl.[5] ..... C10L 9/00; F23K 1/00

[52] U.S. Cl. ..... 44/608; 44/620; 110/342

[58] Field of Search ..... 44/592, 608, 620; 110/342

[56] References Cited

U.S. PATENT DOCUMENTS

| | | | |
|---|---|---|---|
| 2,328,147 | 8/1943 | Hyson | 44/628 |
| 3,909,212 | 9/1975 | Schroeder | 44/622 |
| 4,052,168 | 10/1977 | Koppelman | 44/608 |
| 4,372,227 | 2/1983 | Mahoney et al. | 44/640 |
| 4,377,118 | 3/1983 | Sadowski | 44/640 |

*Primary Examiner*—Margaret Medley

*Attorney, Agent, or Firm*—Polster, Lieder, Woodruff & Lucchesi

[57] ABSTRACT

Coal blends suitable for combustion in a slagging-type combustion apparatus comprise blends of (1) a bituminous coal which forms ash slag having unacceptably high viscosity with (2) a lignitic coal which forms ash slag having marginal viscosity characteristics or $T_{cv}$ whereupon combustion of the blends results in formation of ash slag having viscosity which is synergistically lowered and acceptable for slagging.

16 Claims, 2 Drawing Sheets

COAL BLENDS HAVING IMPROVED ASH VISCOSITY

BACKGROUND OF THE INVENTION

This invention relates to coal blends suitable for combustion in slagging-type combustion apparatus. The blends have the advantage in enabling the use of certain otherwise unsuitable coals as part of the feed to such slagging-type combustors. Enabling the use of such coals for this application increases the potential fuel supply for these units, and in many instances may significantly reduce the overall transportation costs of the coal feed thereby resulting in lowered operating costs for the combustors.

One of the major advances in methods of burning coal in this century has been cyclone-furnace firing. Commonly the Cyclone-Furnace is used in the form of a water-cooled horizontal cylinder with crushed coal entering the burner end of the cyclone, and primary and secondary combustion air introduced tangentially to impart a whirling motion to the incoming coal. Gas temperatures exceeding 3000° F. (1650° C.) are developed. Such high temperature melts the ash, and the melt forms into a layer of liquid slag on the walls. Combustion gases leave through the re-entrant throat of the cyclone at the rear carrying only about 20 to 30 percent of the ash as dust; about 70 to 80 percent of the ash is retained as molten slag which drains away from the burner end through a small slag tap opening, into a slag tank where it is solidified for disposal.

Since ash is removed in fluid form and satisfactory combustion depends upon the formation of a liquid slag layer, the viscosity of the slag at furnace temperatures must permit slag flow to the tapping point.

Generally slag will just flow on a horizontal surface at a viscosity of 250 poises. The temperature at which this viscosity occurs is used as a criterion for suitability of the coal. Typically a temperature of 2600° F. (1427° C.) is considered maximum. Coals having an ash viscosity above 250 poise at 2600° F. are rejected as unsuitable for slagging-type combustion apparatus such as cyclone-furnace. Other slagging-type combustion apparatuses include slag tap furnaces and some partial combustion gasifier designs.

Coals are often classified as having either bituminous or lignitic ash. Bituminous-type ash coals usually contain as a principal component iron and its compounds, e.g., metallic iron, ferrous oxide or ferric oxide. The ferric state tends to increase the temperature required for ash softening and fluidity properties while the metallic and ferrous states tend to lower the required temperature. Lignitic-type ash coals generally contain only small amounts of iron and are little affected by the oxidation state of the iron. Many bituminous coals have a critical temperature above 2600° F., i.e., temperature required to obtain a melted ash having at most a viscosity of 250 poise, thereby rendering such coals unsuitable for slagging-type combustion applications.

It has now been found that such coals may be suitable for combusting in slagging-type combustion apparatus when fed as a blend with certain other coals.

SUMMARY OF THE INVENTION

Accordingly the invention provides a coal blend suitable for combusting in a slagging-type combustion apparatus such that the ash from such blend comprises: (a) from about 50 to about 5 percent by weight (% w) of bituminous-type ash slag with a viscosity above 250 poise at 2600° F., and (b) from 50 to about 95% w of a lignitic-type ash slag with a viscosity at or below 250 poise at 2600° F., and wherein the ash slag of said blend has a viscosity at or below 250 poise at 2600° F.

The invention further provides a method for improving the operation of a slagging-type combustion apparatus which comprises feeding to said boiler the above described coal blend in a mass mean particulate size less than about 20 mm, preferably less than about 100 microns, and withdrawing from said boiler a slag having improved viscosity behavior compared to the slag withdrawn from said boiler when feeding either blend components (a) or (b) alone.

DESCRIPTION OF PREFERRED EMBODIMENTS

Figure 1:
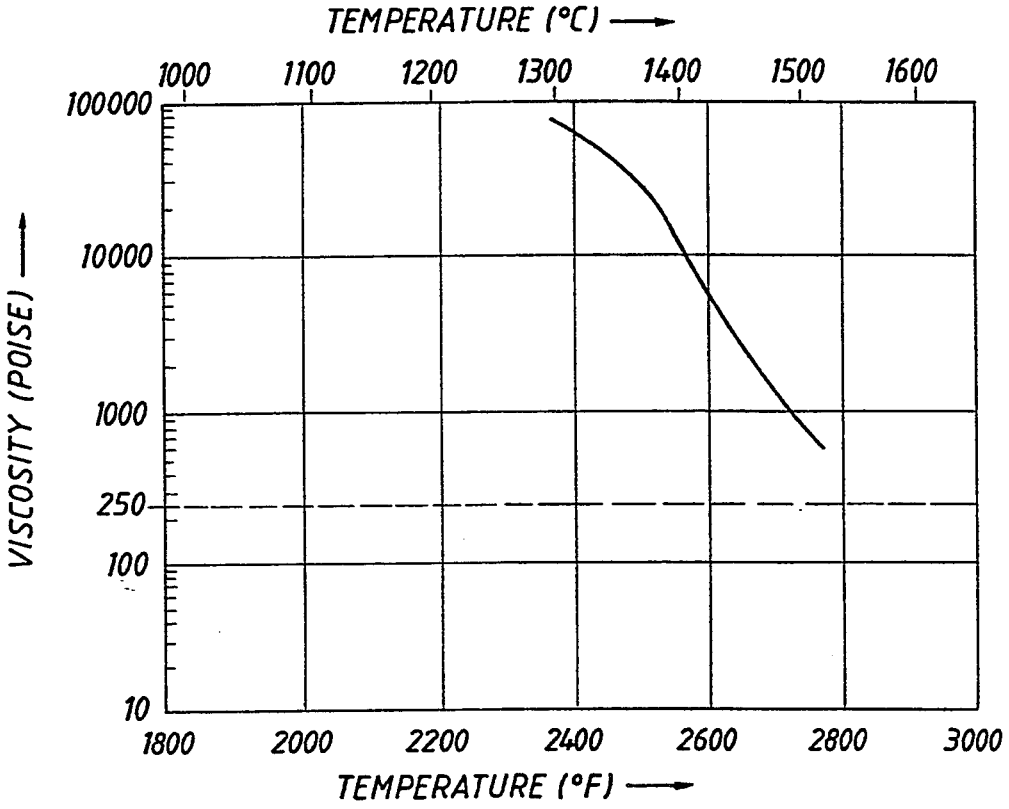
FIG. 1 is a plot showing viscosity of molten ash of a bituminous coal at elevated temperatures.

Generally coals having bituminous-type ash include those of Triassic age or older; coals having lignitic-type ash are those of Jurrasic age and younger and include all ranks of coals in these deposits. Most coals contain significant ash, i.e., residue after combustion. Bituminous coal used in the U.S. for power generation typically has an ash content from about 6 to 20% w, whereas lignitic coal may range from about 4 to about 30% w or more.

Typically ash melts when heated to a sufficiently high temperature. The bituminous coals useful in this invention may have ash which yields melts at a temperature in excess of 2600° F. (1535° C.). Viscosity of coal-ash slag is measured in a high-temperature rotating-bob viscometer. The ash is melted at an elevated temperature; after it becomes uniformly fluid and all decomposition gasses have been expelled, the temperature is decreased in predetermined steps, and the viscosity is measured at each temperature.

The temperature of critical viscosity ($T_{cv}$) is the temperature for the transition of a slag on cooling from a Newtonian fluid to a psuedoplastic fluid. Although attempts have been made, predicting $T_{cv}$ from composition of the ash is not easily done. The $T_{cv}$ depends on the separation of a solid phase in the molten slag, a process that may require several hours for viscous melts. Further, only trace amounts of solids may lead to thixotropic slags that do not have the flow characteristics of Newtonian slags.

The suitability of coals for the cyclone-furnace is dependent upon ash content and chemical composition of the ash, as well as moisture and volatile contents of the coal. Customarily the composition of ash is determined by chemical analysis of the residue produced by burning a sample of the coal at a slow rate and moderate temperature of 1450° F. (788° C.) under oxidizing conditions in a laboratory furnace. The constituents of coal ash are sometimes referred to as either acidic or basic. An "acidic oxide" is a metal oxide capable of reacting with calcium oxide or similar oxides under pyrochemical conditions. Typical acidic oxides in coal ashes are silicon dioxide, aluminum oxide and titanium dioxide. A "basic oxide" is a metal oxide such as calcium oxide that can react with an acidic oxide such as silicon dioxide under like conditions. Common bases in coal ash include ferric oxide, calcium oxide, magnesium oxide, sodium oxide and potassium oxide.

An advantage of a slagging-type combustion apparatus is that a high percentage of the ash is retained as opposed to leaving the unit in the form of dust entrained in the flue gas. Typically, when pulverized coal is burned in a slag-tap furnace, as much as 50% of the ash may be retained; with a cyclone-furnace 70 to 80% of the total ash is retained.

For cyclone-furnaces the coal feed need only be crushed so that about 95% will pass through a 4-mesh screen (U.S. Standard Sieve Designation) as opposed to combustion apparatus requiring that the coal be pulverized to a powder so fine that approximately 70 percent will pass through a 200-mesh screen. The coal blends according to the invention will have a mass mean particulate size less than about 20 mm and most preferably less than about 100 microns. Slag-tap furnaces rarely are suited for using coals having an ash viscosity greater than 250 poise at 2600° F. (1427° C.).

The blends according to the invention will be formed at any time prior to being fed to the slagging-type combustion unit. Typically each of the components are unloaded into separate stockpiles or are conveyed to the coal-blending plant, mixed crushed and stored in storage bunkers near the combustion unit. Alternately each coal may be processed separately in a crusher such as a Bradford breaker to reduce top size of the particles to about 25 mm and to remove extraneous materials such as rock and the like. The coals are then placed in two or more mixer bins from which they are withdrawn onto a horizontal conveyor belt. An adjustable valve meters a constant volume of each coal per unit of time onto the belt in the proportion for the desired blend.

Another technique is to use vibrating feeders or flow weighing devices to meter the coals by weight. The mixer belts carry each coal to a common hopper which feeds the final crusher or hammermill for mixing and final comminution of the particles. Alternately each coal may be blended in the desired proportions and mixed by paddle, twin-screw or other mixers or by passage over riffle splitters.

The coal blends may be fed to the slagging-type combustor in any conventional feeding system, such as the bin, direct-firing and the direct-firing pre-drying bypass systems.

The invention will now be described in more detail by reference to the following illustrative embodiment.

Illustrative Embodiments

A bituminous coal having an ash content of about 7% w and ash analysis as shown in the Table was tested to determine the coal ash viscosity over a range of elevated temperatures. The ash was prepared by ashing a representative coal sample in a furnace at 815° F. (435° C.) for approximately 36 hours. The ash which was stirred periodically and weighed was allowed to remain in the furnace until it reached a constant weight.

TABLE

| ANALYSIS OF COAL ASH | | |
|---|---|---|
| | WEIGHT %, IGNITED BASIS | |
| ANALYSIS | BITUMINOUS (a) | LIGNITIC (b) |
| Silicon dioxide | 55.57 | 28.18 |
| Aluminum oxide | 27.48 | 13.13 |
| Titanium dioxide | 1.58 | 0.92 |
| Iron oxide | 6.47 | 7.36 |
| Calcium oxide | 0.65 | 24.56 |
| Magnesium oxide | 1.42 | 6.07 |
| Potassium oxide | 3.75 | 0.15 |
| Sodium oxide | 0.28 | 0.12 |
| Sulfur trioxide | 0.31 | 17.61 |
| Phosphorus pentoxide | 0.06 | 0.47 |
| Strontium oxide | 0.11 | 0.41 |
| Barium oxide | 0.00 | 0.87 |
| Manganese oxide | 0.11 | 0.15 |
| Undetermined | 2.21 | 0.00 |
| | 100.00 | 100.00 |
| Silica value | 86.68 | 42.59 |
| Base:acid ratio | 0.15 | 0.91 |

The ash was then loaded into a crucible. The crucible had been machined out of 99.94% molybdenum stock, which is stable under the severe conditions of this test to enable testing of the ash. The ash in the crucible was then melted in an induction furnace under an atmosphere of argon gas.

The high-temperature viscometer technique employs a cylindrical rotor bob (also machined out of 99.94% molybdenum), which is immersed in the crucible filled to the proper depth with molten coal ash. The design of the furnace used allows the measurements to be made in a contained gaseous environment of argon gas. The furnace is calibrated for temperature offsets as a function of ramp rates of 4° C. per minute of cooling so that the actual melt temperature is known accurately. The torque measuring head that turns the bob is a Haake M5, connected to a Haake RV20 readout. When the furnace containing the ash loaded crucible is up to temperature the bob is lowered into the molten ash so that the bottom of the bob is 1 inch above the bottom of the crucible. Viscosity measurements are taken as the furnace is ramped down at a constant rate of 4° C. per minute. As shown in FIG. 1 the ash from this bituminous coal had a viscosity above 500 poise at the maximum attempted temperature of 2800° F. (1540° C.). This coal had a $T_{250}$ above 2800° F. and would be unsuitable for use in slagging-type combustors.

Figure 2:
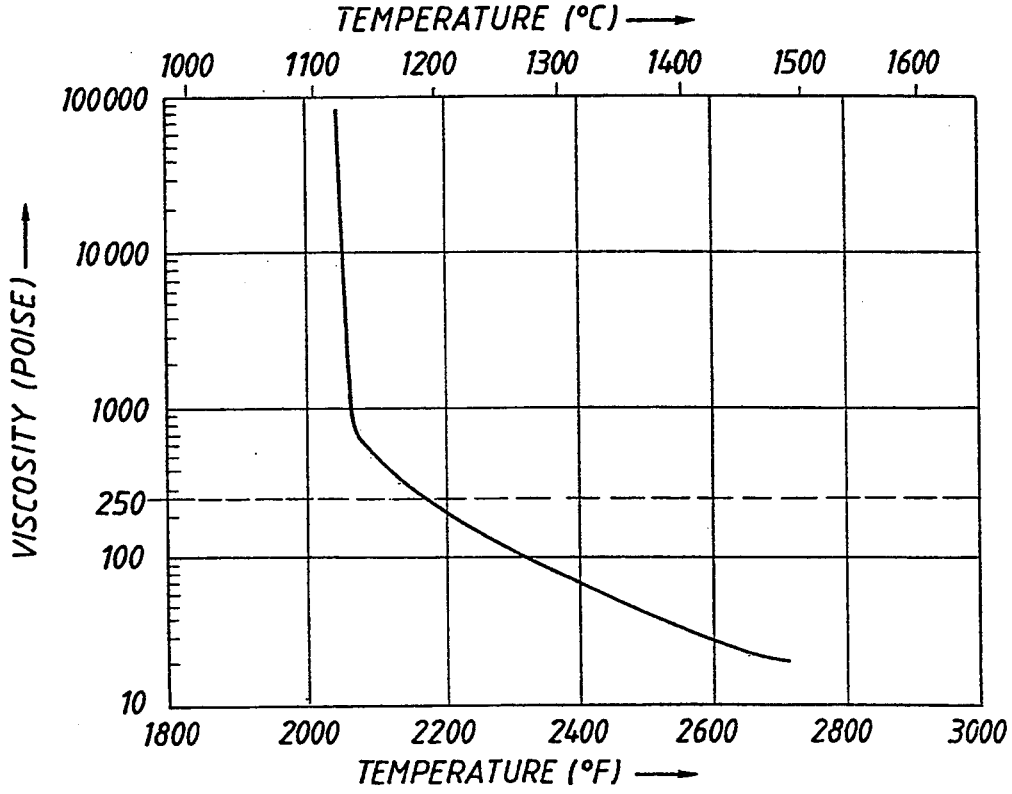
FIG. 2 is a plot showing viscosity of molten ash of a lignitic coal at elevated temperatures.

The foregoing procedure was repeated with a lignitic coal having ash content of about 7% w and an ash analysis shown in the Table. As shown in FIG. 2 the ash from this lignitic coal had a $T_{250}$ of about 2160° F. (1182° C.).

To illustrate the advantage of the invention, blends were prepared of 10% w and 20% w ash from the same bituminous coal with 90% w and 80% w, respectively, of ash from the same lignitic coal.

Figure 3:
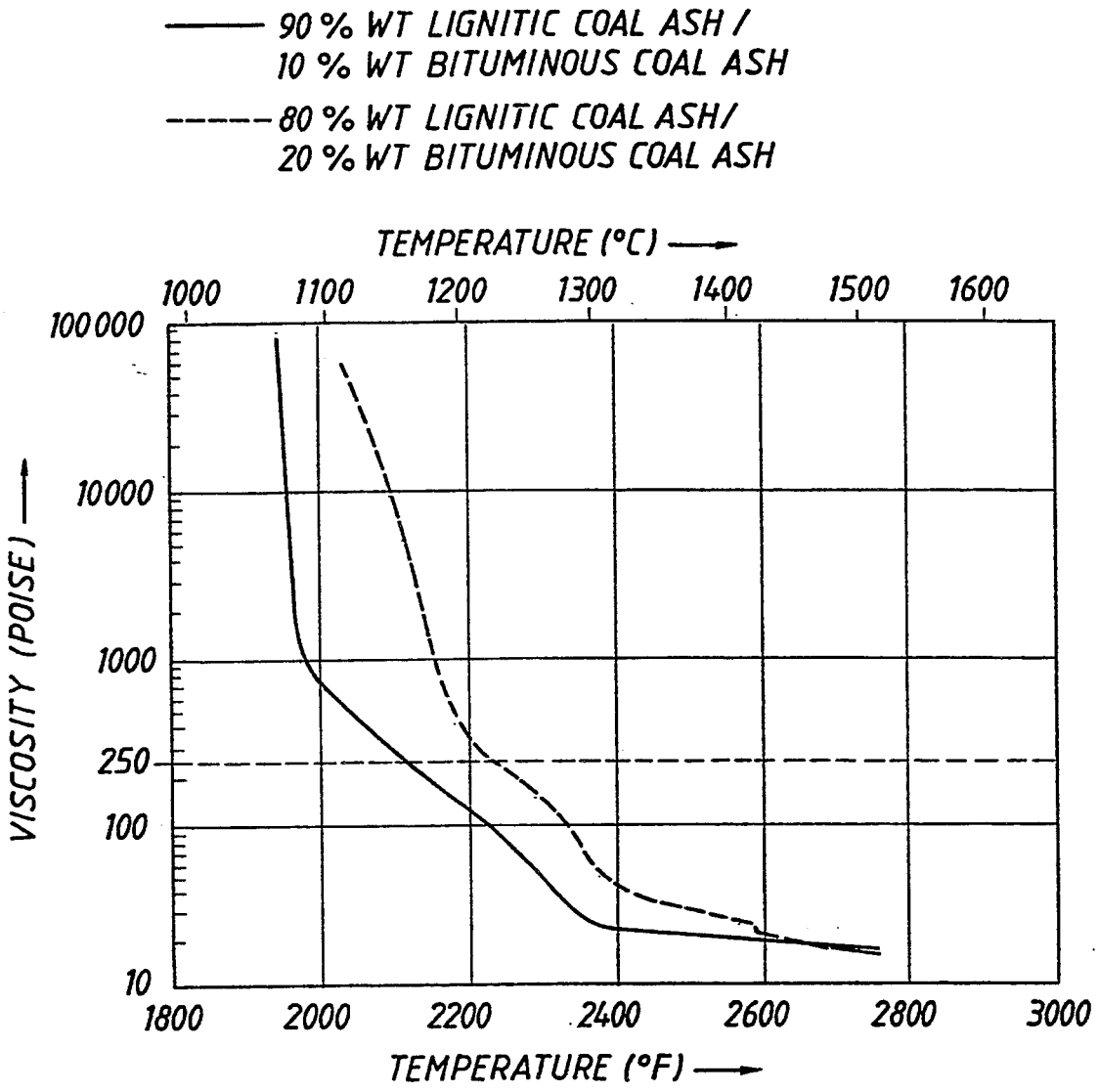
FIG. 3 is a plot showing viscosity of molten ash of blends of 10 and 20% w of the same bituminous coal with the same lignitic coal at elevated temperatures.

As shown in FIG. 3, the $T_{250}$ of the 10% w blend is about 2100° F. (1149° C.) which is lower than either of the original components. The viscosity profile of the 20% w blend is lower than that of the heat bituminous coal over a significant part of the temperature range examined. Optimization of the blend ratio might lead to further improvement, i.e., a lower viscosity profile than the 10% w blend case. Accordingly, blends of lignitic coal containing significant amounts of bituminous coal may be used in slagging-type combustors.

Particularly preferred are blends having an ash content in the range from about 4 to about 30% w and on an ignited basis a potassium oxide content less than about 1% w.

Preferably, blends according to the invention include as component (a) at least one bituminous coal having an ash content in the range from about 5 to about 30% w and on an ignited basis having a lime and magnesia content from about 2 to about 10% w. More preferably component (a) will have a sulfur content less than about 1% w. Particularly preferred are blends wherein component (a) has a base/acid ratio from about 0.1 to about 0.4.

The coal blends according to the invention employ as component (b) at least one lignitic coal having an ash content in the range from about 4 to about 12% w and on an ignited basis having a ferric oxide content from about 3 to about 8% w. A particularly preferred component (b) is the solid residue remaining from gasification of a lignitic coal and under mild conditions, i.e., atmospheric pressure and elevated temperatures of about 900° up to about 1000° F. Several such mild gasification processes are known to partly pyrolyze the coal to cause chemical changes in the feed coal by drying and heating under controlled conditions. Mild gasification partially devolatilizes and chemically changes the coal, producing gases which are separated and solid residue having reduced volatile content and improved heating value. Generally, the ash content of the residue is higher than that of the feed coal, however, the chemical constituents and fusion temperature of the ash are not substantially different from the parent coal.

What is claimed is:

1. A method of operation of a slagging-type coal fired combustion apparatus comprising: feeding to the combustion apparatus a blend of coals, the blend comprising
   (a) coal having bituminous ash wherein ash slag from the coal having a bituminous ash has a viscosity above 250 poise at 2600° F.; and
   (b) coal having a lignitic ash wherein ash slag from the coal having a lignitic ash has a viscosity at or below 250 poise at 2600° F. wherein the blend has an ash content of at least about 6% w, wherein ash slag from the blend has a viscosity of 250 poise or less at 2600° F., and wherein about 50 to about 5% w of the ash from the blend is from the coal having bituminous ash and about 50 to about 95% w of the ash from the blend is from the coal having the lignitic ash; and withdrawing slag from the apparatus.

2. The method of claim 1 wherein the ash slag of said blend has a viscosity at 2600° F. which is less viscous than that of said ash slag of component (b) at 2600° F.

3. The method of claim 1 wherein component (a) is a coal having an ash content in the range from about 5 to about 30% w and on an ignited basis has a total lime and magnesia content from about 2 to about 10% w.

4. The method of claim 1 wherein component (a) on a dry basis has sulfur content less than about 1.0% w.

5. The method of claim 1 wherein ash form component (a) has a base/acid ratio from about 0.1 to about 0.4.

6. The method of claim 1 wherein component (b) has an ash content in the range from about 4 to about 12% w and on an ignited basis has a ferric oxide content from about 3 to about 8% w.

7. The method of claim 1 wherein the blend has an ash content in the range from about 4 to about 30% w and on an ignited basis a potassium oxide content less than about 1.0% w.

8. The method of claim 1 wherein component (b) is the solid residue product resulting from mild gasification of a lignitic coal.

9. A method as in claim 1 wherein said apparatus is a cyclone-furnace.

10. The method of claim 1 wherein the coal blend has a mass mean particulate size of less than about 20 mm.

11. The method of claim 10 wherein the coal blend has a mass mean particulate size of less than about 100 microns.

12. The method of claim 1 wherein ash from the coal having a bituminous ash is on an ignited basis, about two percent by weight calcium oxide plus magnesium oxide.

13. The method of claim 12 wherein ash from the coal having a bituminous ash is on an ignited basis, about six percent by weight iron oxide.

14. The method of claim 1 wherein ash from the coal having a lignitic ash is on an ignited basis, about thirty one percent by weight calcium oxide plus magnesium oxide.

15. The method of claim 14 wherein ash from the coal having a lignitic ash is, on an ignited basis, about seven percent by weight iron oxide.

16. The method of claim 15 wherein ash from the coal having a bituminous ash is, on an ignited basis, about two percent by weight calcium oxide plus magnesium oxide, and about six percent by weight iron oxide.

* * * * *